US005191533A

United States Patent [19]

Haug

[11] Patent Number: 5,191,533

[45] Date of Patent: * Mar. 2, 1993

[54] FRANKING MACHINE

[75] Inventor: Werner Haug, Langnau, Switzerland

[73] Assignee: Frama AG, Lauperswil, Switzerland

[ * ] Notice: The portion of the term of this patent subsequent to Jul. 28, 2009 has been disclaimed.

[21] Appl. No.: 490,040

[22] Filed: Mar. 7, 1990

[30] Foreign Application Priority Data

Mar. 8, 1989 [CH] Switzerland ..... 00853/89

[51] Int. Cl.[5] ..... G07B 17/02

[52] U.S. Cl. ..... 364/464.03; 177/25.15

[58] Field of Search ..... 364/464.03, 464.02, 364/709.15, 709.16; 177/25.15

[56] References Cited

U.S. PATENT DOCUMENTS

| | | | |
|---|---|---|---|
| 4,097,923 | 6/1978 | Eckert, Jr. et al. | 364/900 |
| 4,120,040 | 10/1978 | Aihara | 364/709.15 |
| 4,495,581 | 1/1985 | Piccione | 177/25.15 X |
| 4,499,545 | 2/1985 | Daniels et al. | 364/464.02 |
| 4,520,725 | 6/1985 | Haug | 101/110 X |
| 4,731,728 | 3/1988 | Muller | 364/464.02 X |
| 4,788,623 | 11/1988 | Haug | 361/171 |
| 4,814,995 | 3/1989 | Daniels, Jr. | 364/464.02 |
| 4,898,093 | 2/1990 | Haug | 101/110 X |
| 4,901,241 | 2/1990 | Schneck | 364/464.02 |
| 4,947,333 | 8/1990 | Sansone et al. | 364/464.03 X |

*Primary Examiner*—Thomas G. Black
*Assistant Examiner*—Edward R. Cosimano
*Attorney, Agent, or Firm*—Ladas & Parry

[57] ABSTRACT

To obviate the need for reading a postage rate table for franking purposes, its content is stored in the memory of the central control unit of the franking machine and the franking value is calculated in the computer of the central control unit on the basis of the entry of the weight of the article to be franked and is automatically set. Weight entry can take place automatically by an electronic balance connected across an interface or manually using entry keys (21-25) after setting the entry mode by a special key ("ENTER WT", 180). For calculating the franking value it is possible to input into the franking machine control unit further informations influencing the rate concerning the destination, size of the article to be franked and dispatch type by using surcharge keys (118, "DEST"; 120, "SIZE"; 56, "AIR"; 57, "EXP"; 58, "REG"). A main display (65) is used for the weight display, as well as the display of the calculated and mechanically set franking value.

3 Claims, 15 Drawing Sheets

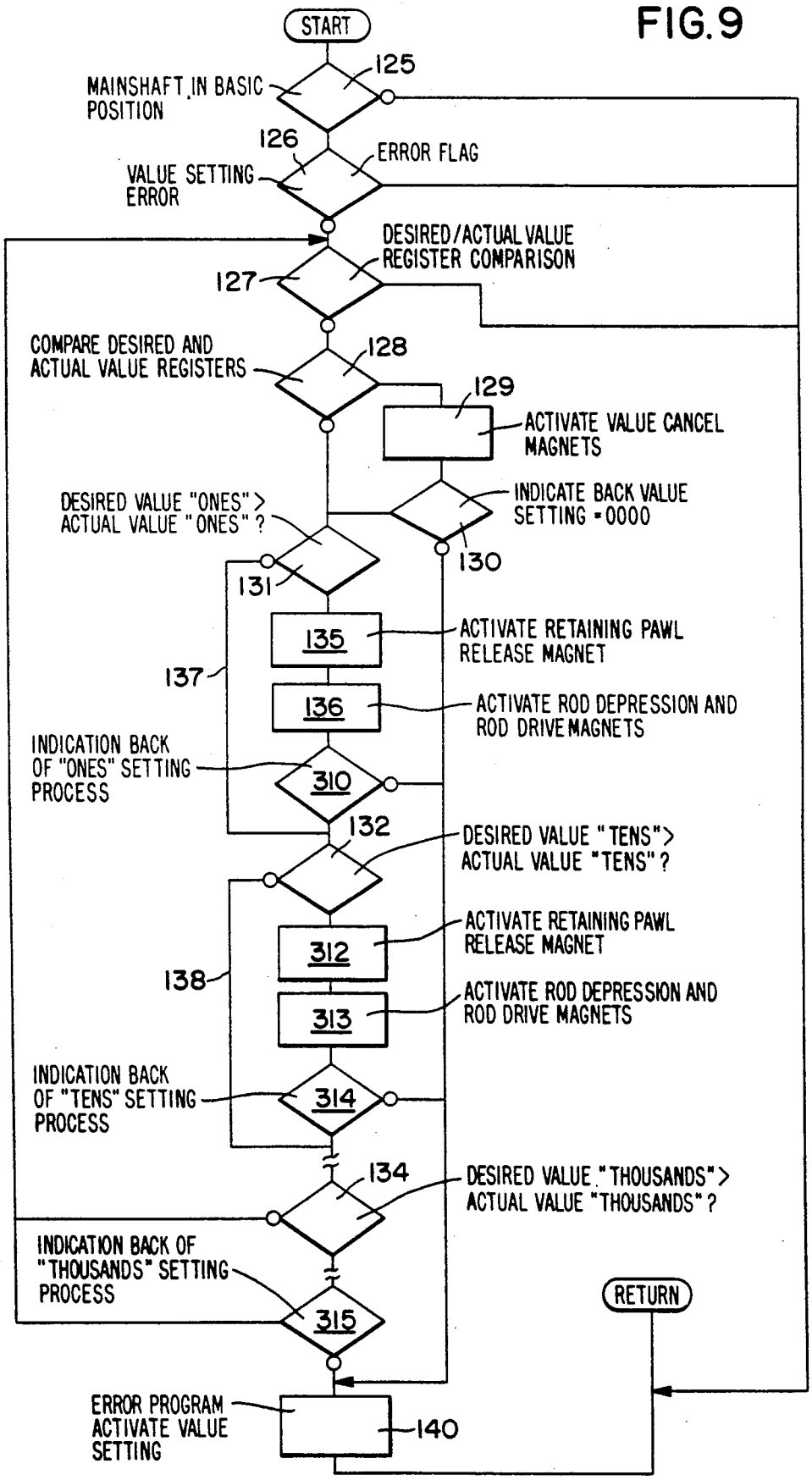
FIG. 9
START
125
MAINSHAFT IN BASIC POSITION
126
ERROR FLAG
VALUE SETTING ERROR
DESIRED/ACTUAL VALUE REGISTER COMPARISON
127
COMPARE DESIRED AND ACTUAL VALUE REGISTERS
128
129
ACTIVATE VALUE CANCEL MAGNETS
INDICATE BACK VALUE SETTING = 0000
DESIRED VALUE "ONES" > ACTUAL VALUE "ONES"?
130
131
135
ACTIVATE RETAINING PAWL RELEASE MAGNET
137
136
ACTIVATE ROD DEPRESSION AND ROD DRIVE MAGNETS
INDICATION BACK OF "ONES" SETTING PROCESS
310
132
DESIRED VALUE "TENS" > ACTUAL VALUE "TENS"?
312
ACTIVATE RETAINING PAWL RELEASE MAGNET
138
313
ACTIVATE ROD DEPRESSION AND ROD DRIVE MAGNETS
INDICATION BACK OF "TENS" SETTING PROCESS
314
134
DESIRED VALUE "THOUSANDS" > ACTUAL VALUE "THOUSANDS"?
INDICATION BACK OF "THOUSANDS" SETTING PROCESS
315
RETURN
ERROR PROGRAM ACTIVATE VALUE SETTING
140

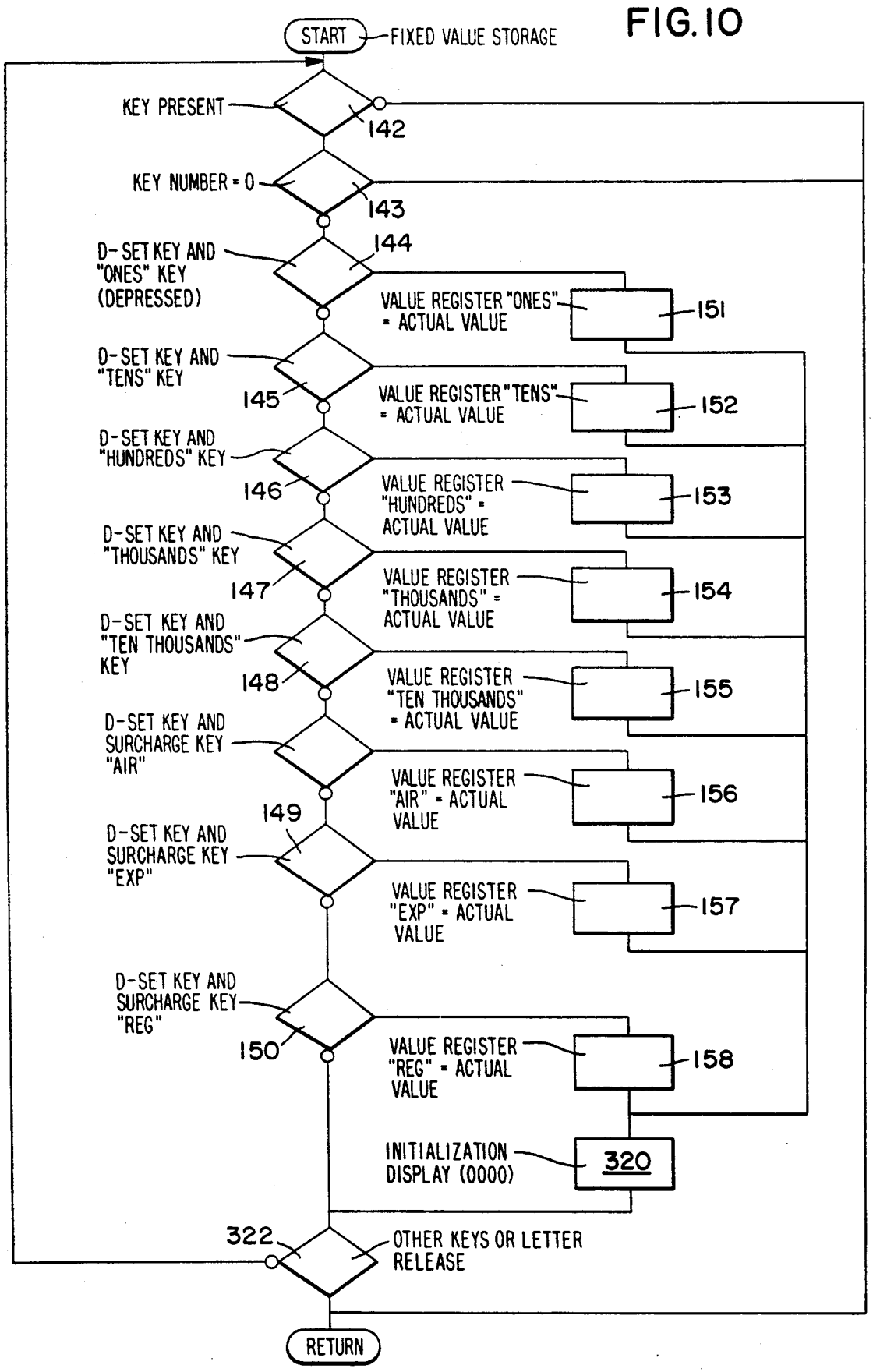
FIG. 10
START
FIXED VALUE STORAGE
KEY PRESENT
142
KEY NUMBER = 0
143
D-SET KEY AND "ONES" KEY (DEPRESSED)
144
VALUE REGISTER "ONES" = ACTUAL VALUE
151
D-SET KEY AND "TENS" KEY
145
VALUE REGISTER "TENS" = ACTUAL VALUE
152
D-SET KEY AND "HUNDREDS" KEY
146
VALUE REGISTER "HUNDREDS" = ACTUAL VALUE
153
D-SET KEY AND "THOUSANDS" KEY
147
VALUE REGISTER "THOUSANDS" = ACTUAL VALUE
154
D-SET KEY AND "TEN THOUSANDS" KEY
148
VALUE REGISTER "TEN THOUSANDS" = ACTUAL VALUE
155
D-SET KEY AND SURCHARGE KEY "AIR"
VALUE REGISTER "AIR" = ACTUAL VALUE
156
149
D-SET KEY AND SURCHARGE KEY "EXP"
VALUE REGISTER "EXP" = ACTUAL VALUE
157
D-SET KEY AND SURCHARGE KEY "REG"
150
VALUE REGISTER "REG" = ACTUAL VALUE
158
INITIALIZATION DISPLAY (0000)
320
322
OTHER KEYS OR LETTER RELEASE
RETURN

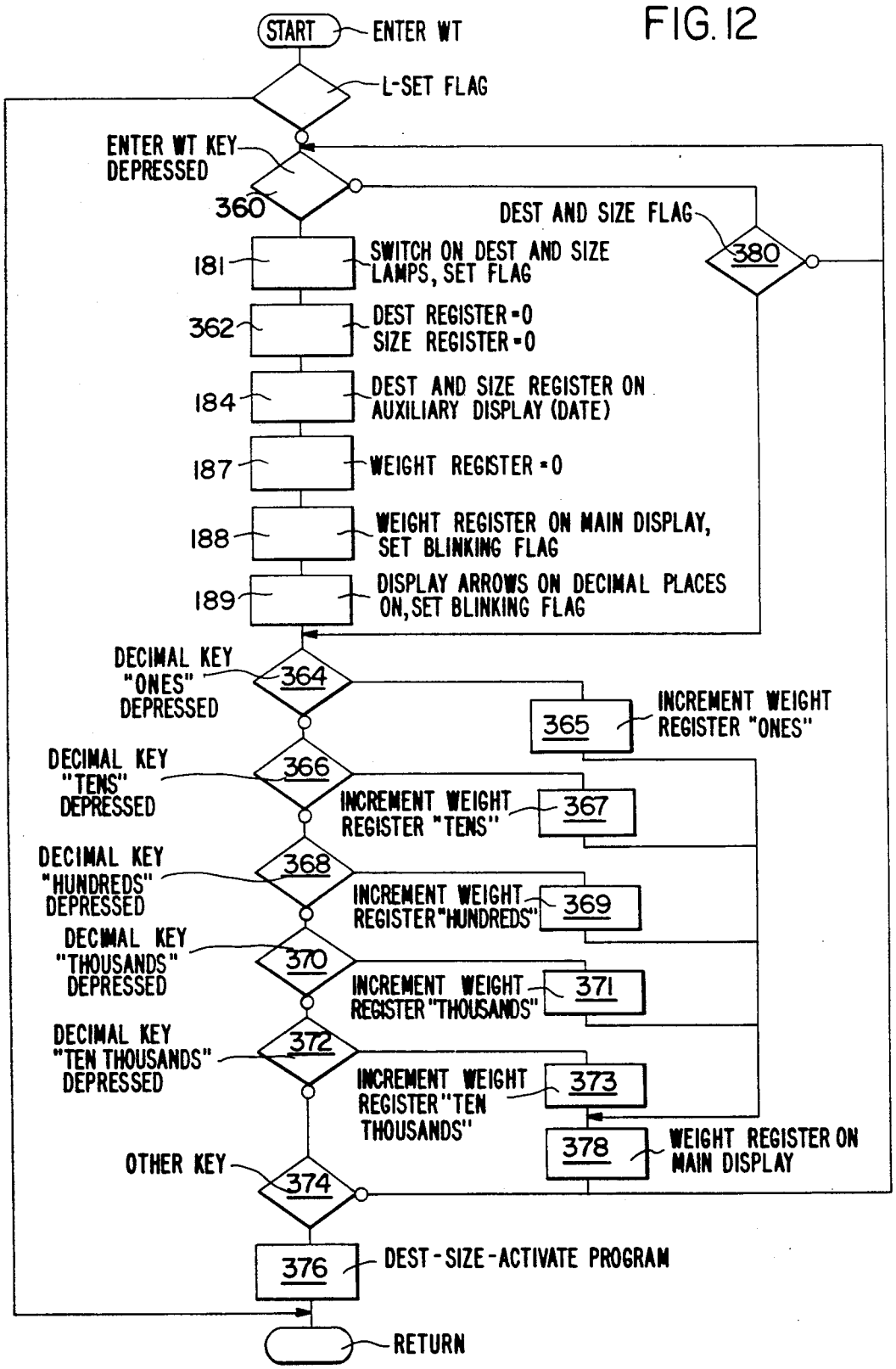
FIG. 12
START
ENTER WT
L-SET FLAG
ENTER WT KEY DEPRESSED
360
DEST AND SIZE FLAG
380
181
SWITCH ON DEST AND SIZE LAMPS, SET FLAG
362
DEST REGISTER=0
SIZE REGISTER=0
184
DEST AND SIZE REGISTER ON AUXILIARY DISPLAY (DATE)
187
WEIGHT REGISTER=0
188
WEIGHT REGISTER ON MAIN DISPLAY, SET BLINKING FLAG
189
DISPLAY ARROWS ON DECIMAL PLACES ON, SET BLINKING FLAG
DECIMAL KEY "ONES" DEPRESSED
364
365
INCREMENT WEIGHT REGISTER "ONES"
DECIMAL KEY "TENS" DEPRESSED
366
INCREMENT WEIGHT REGISTER "TENS"
367
DECIMAL KEY "HUNDREDS" DEPRESSED
368
INCREMENT WEIGHT REGISTER "HUNDREDS"
369
DECIMAL KEY "THOUSANDS" DEPRESSED
370
INCREMENT WEIGHT REGISTER "THOUSANDS"
371
DECIMAL KEY "TEN THOUSANDS" DEPRESSED
372
INCREMENT WEIGHT REGISTER "TEN THOUSANDS"
373
378
WEIGHT REGISTER ON MAIN DISPLAY
OTHER KEY
374
376
DEST-SIZE-ACTIVATE PROGRAM
RETURN SURCHARGE KEY AIR DEPRESSED
430
431
ERASE AIR KEY FLAG
AIR KEY FLAG
203
204
SET AIR KEY FLAG
AIR FLAG SET
432
210
ERASE AIR FLAG
205
SET AIR FLAG
206
SWITCH ON AIR LAMP
SWITCH OFF AIR LAMP
211
SIZE TIMER RUN OUT
424
LOAD SIZE TIMER
201
EXP ENTRY PROGRAM
433
REG SURCHARGE KEY
434
ERASE REG KEY FLAG
REG KEY FLAG
204
207
SET REG KEY FLAG
REG FLAG SET
435
212
ERASE REG FLAG
208
SET REG FLAG
209
SWITCH ON REG LAMP
SWITCH OFF REG LAMP
213
OTHER KEY
436
RETURN

FRANKING MACHINE

BACKGROUND OF THE INVENTION

The invention relates to a franking machine with a printing head fixed to a machine mainshaft, a drive for the machine mainshaft, in order to rotate the printing head for at least one printing cycle, typewheels mounted in rotary manner in the printing head for printing the value, an electromechanical drive for each of the typewheels for setting a desired franking value, mechanical locking means for securing the setting positions of control members of the electromechanical drive, sensors for supplying position signals of the locking means to a central electronic control unit for the control of the electromechanical drive and a control console with a keyboard for the random inputting of instructions to the control unit for setting the typewheels of the printing head and with a display for displaying the inputted instructions.

In a known franking machine of this type (U.S. Pat. No. 4,097,923), the instructions to an electronic control unit for setting the franking value are only inputted via a tens' keyboard and the setting of the inputted amount on the franking head takes place after operating an additional release key. However, it is necessary beforehand to determine the amount to be entered by means of a table of postal rates after weighing the envelope to be franked, account also having to be taken of its destination and dimensions.

In order to avoid reading a table for determining the necessary amount of the franking value, a balance has been proposed, which calculates the franking value by means of an incorporated computer, so that said value can be read from a display and is subsequently inputted via the keyboard of the separate franking machine. Such a balance with a postage rate computer is roughly as expensive as the franking machine, without reducing the operating costs during the inputting of the determined amount into the franking machine.

SUMMARY OF THE INVENTION

The problem of the invention is to significantly simplify the operation of a franking machine of the aforementioned type, so that the user does not have to read a postage rate table. This is in particular intended to avoid a complicated and specially designed electronic balance with a rate computer.

According to the invention this problem is solved in that the central control unit of the franking machine has a memory in which is stored a postage rate table, inputting means are provided for entering the weight of an article to be franked, together with a computer for calculating a franking value on the basis of the weight entry and a program memory for the automatic control of the electromechanical drive on the basis of the calculated franking value.

Thus, any conventional, simple balance is suitable for determining the weight amount.

The weight entry can be inputted or entered manually by means of a keyboard on the franking machine, or automatically by the connection of an electronic balance across an interface.

The number of keys necessary for entering the weight, e.g. on a control console of the franking machine, can correspond to the number of decimal places of a maximum amount to be entered, so that far fewer keys are required than with a tens keyboard. Thus, only three instruction keys are required for inputting three-figure weight amounts.

In order to also permit the entry of franking value amounts into the franking machine to enable the latter to be used in a more universal way, the franking machine preferably has a separate "enter weight" (ENTER WT) key permitting switching between two entry or inputting types. Preferably the same keys are used for both types. It is obvious that for this franking machine embodiment the number of keys for the amount to be entered corresponds to the number of decimal places of a maximum possible franking value amount. Here again the entry for each decimal place takes place incrementally or cyclicly by an operation of the same decimal key corresponding to the number to be set.

It is finally also possible to associate with these keys fixed value amounts corresponding to the most frequently occurring franking values by means of corresponding programming of the central control unit of the franking machine through key entry. Thus, the franking machine can be switched to a third entry type for franking value settings, in which cyclic entry is avoided. This switching and the aforementioned programming can take place by means of a further special "D-SET" key. As will be discussed hereinafter, after pressing the D-SET key, the franking value is established by cycling through individual digits of the value display. However, when any value key is, instead, pressed without pressing the D-SET key, then a fixed value associated with that value key is selected. The D-SET is also used for programming each value key to set such key to a desired fixed value.

The cyclic or incremental entry of franking amounts can be further limited by providing further keys with which can be associated, by programming with the aid of the separate D-SET key, further predetermined franking value amounts by means of the program memory of the central' control unit. Such further keys for the direct inputting of fixed values can also be surcharge keys for special postage dispatch types to be additionally operated and which require a surcharge to the basic franking value amount to be added to the set basic amount, such as e.g. for express dispatches (EXP), registered mail (REG) or airmail dispatches (AIR). By using these surcharge keys there is a further reduction in the small number of cases where a cyclic entry of a franking value amount would be necessary.

In the case of the entry type with weight entry these surcharge keys (AIR, EXP, REG) can provide information corresponding to the surcharge amount to the computer of the central unit of the franking machine which calculates the total amount. In order to also provide said computer with information concerning the destination and size of the envelope to be franked, there can additionally be "DEST" and "SIZE" entry keys.

The keys for the weight entry or franking value entry are preferably so arranged on a display panel of the control console that each key is spatially associated with that part of the display panel on which, in the case of cyclic value entry, appears the decimal place to be set by it. However, the keys for the destination (DEST) and size (SIZE) can be so arranged on an additional display panel, that the code figures corresponding to the entry information appear on a display panel in the vicinity of the corresponding key.

The switching on of the special or separate keys and the surcharge keys is preferably indicated by light emitting diodes associated therewith.

BRIEF DESCRIPTION OF THE DRAWINGS

Advantageous embodiments of the invention are described in greater detail hereinafter relative to the drawings, wherein show:

FIG. 9 A flowchart for representing the program sequence of the electronic control unit on setting the value of the typewheels on the basis of the preceding value entry or on the basis of the value amount calculated by the computer after weight entry.

FIG. 10 A flowchart of the programming of the electronic control unit for the association of predetermined value quantity amounts with the entry keys.

FIG. 12 A flowchart of a program sequence when the weight is entered manually by means of the keyboard.

DETAILED DESCRIPTION OF THE INVENTION

A franking machine of the type on which the invention is based and in particular the locking means for securing the setting positions and for preventing wrong settings is e.g. known from Swiss patent 699 059 (U.S. Pat. No. 4,898,093) and is described in detail therein. The operation of the electromechanical drive of the typewheels is also described in U.S. Pat. No. 4,520,725. Therefore the following description is limited, whilst referring to and incorporating herein these prior publications to the essential part of the machine mechanism necessary for the understanding of the present invention.

Figure 1:
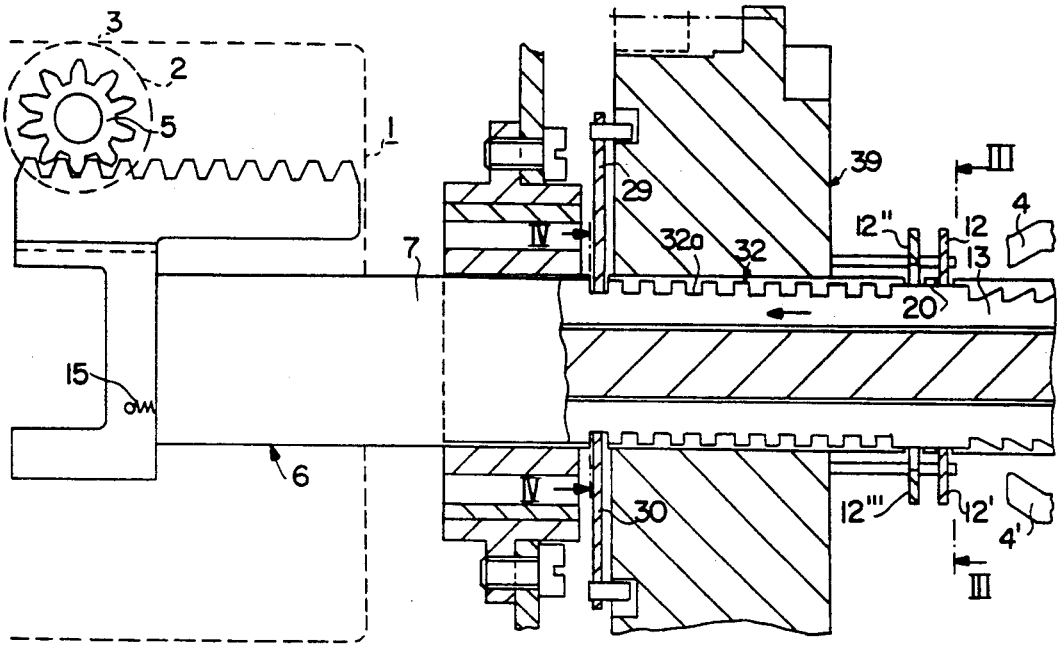
FIG. 1 A partial view of the franking machine as a section along the mainshaft thereof.

In FIG. 1, typewheels 2 mounted in the franking head 1 and whereof one is provided for each decimal place of the value amount to be printed, carry on their circumference the FIGS. 0–9. The setting of a specific figure takes place by the stepwise rotation starting from the zero position.

Figure 6:
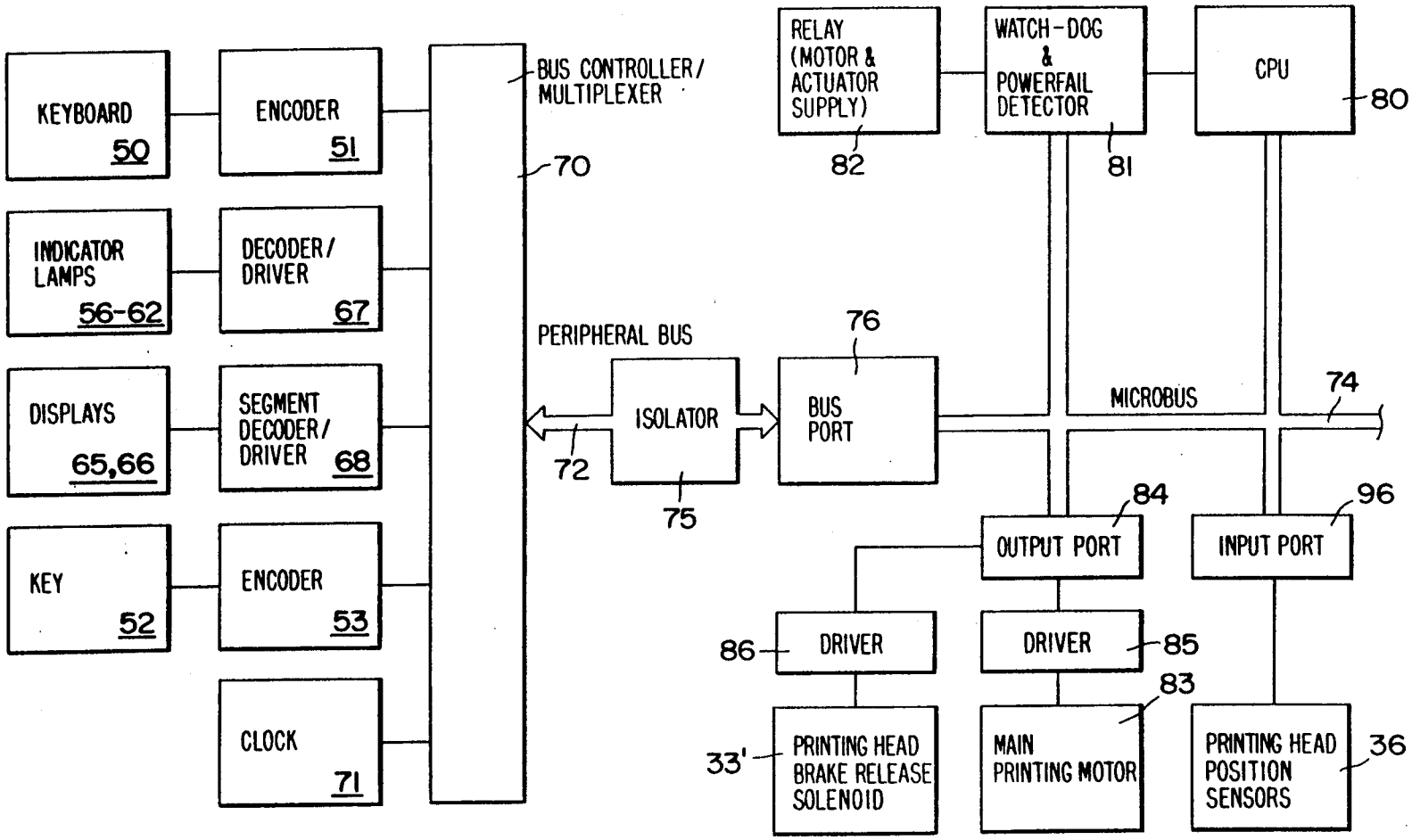
FIG. 6 A first half of a simplified block diagram of the central control unit of the franking machine.
Figure 7:
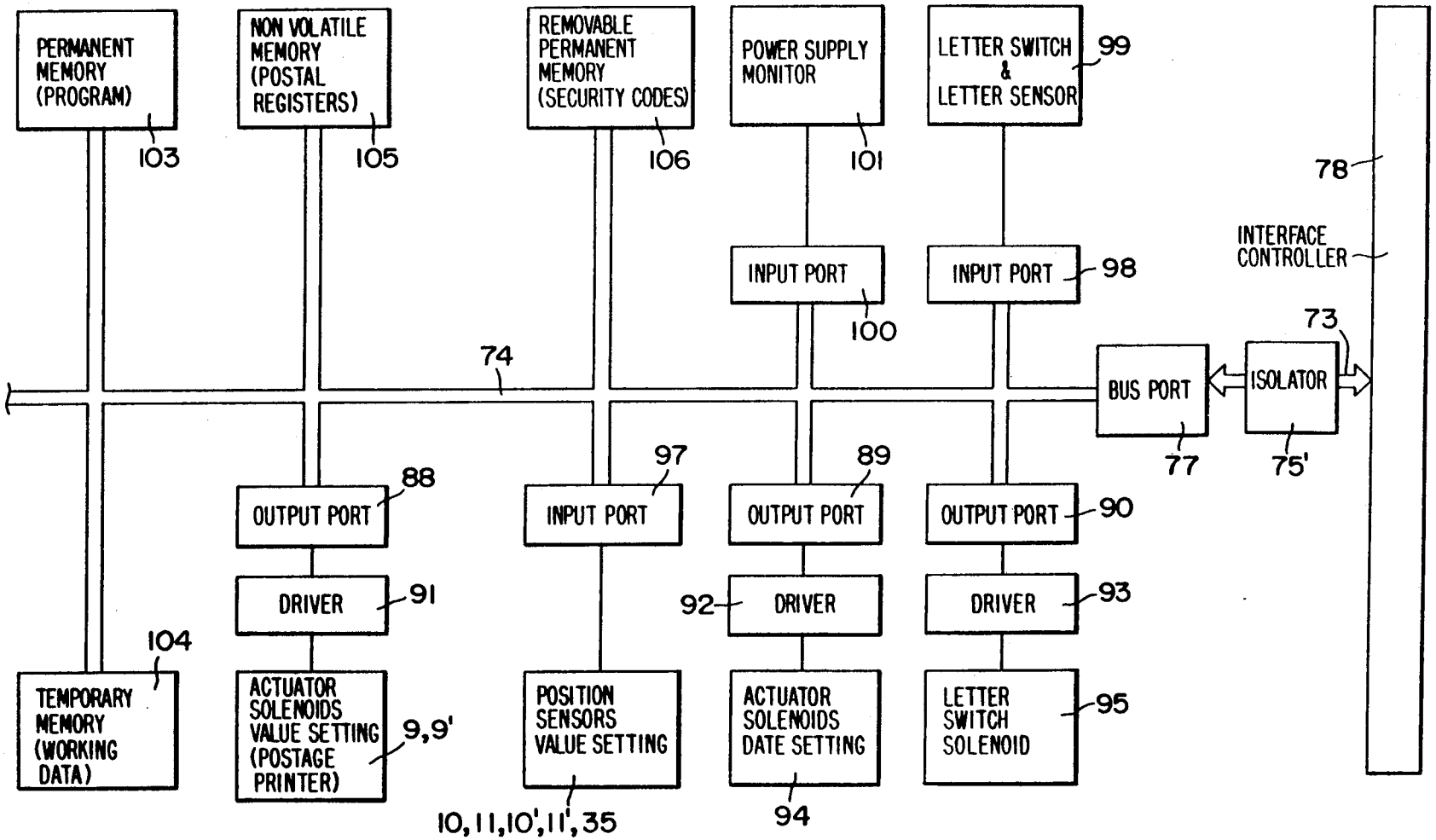
FIG. 7 The second half with respect to the block diagram of FIG. 6.

In order e.g. to move the FIG. "4" of typewheel 2 of a decimal place into the printing position on the circumference 3 of the printing head, a drive rod 4, 4' provided for the particular decimal place four times carries out a picking engagement motion and a percussive motion, so that the rack 7 guided in the machine mainshaft 6 and constantly engaged with the pinion 5 is correspondingly stepwise shifted counter to the tension of a tension spring 15. Two solenoids 9 are provided for these movements of the drive rod 4 and they receive their electric pulses from a central control unit (FIGS. 6 and 7).

Figure 3:
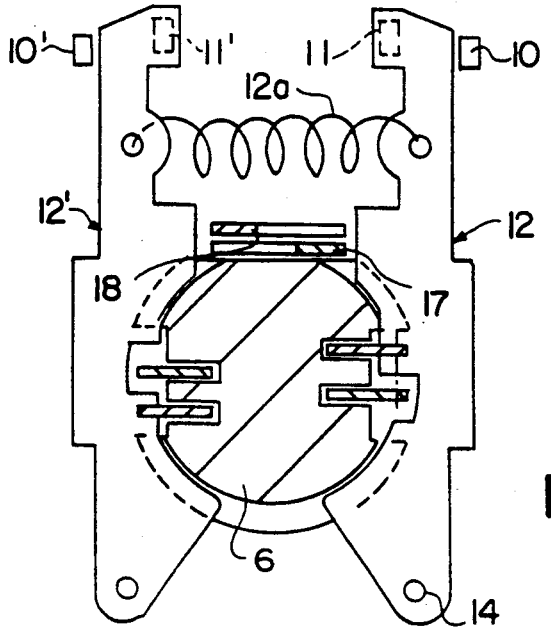
FIG. 3 A cross-section through the machine mainshaft along line III—III of FIG. 1.

The stepwise rack movement is checked by a back-indication to the control unit by means of optical sensors 10, 11 (FIG. 3). The latter are located in the movement path of a detent 12 which, through its resilient engagement with a drive tooth system 13 of the particular rack 7, is pivoted during each further movement by one tooth and therefore during each setting of a following figure of the typewheel 2 about a spindle 14. As a result of its engagement, detent 12 also ensures that the rack 7 does not unintentionally move back into the detent starting position as a result of the tension of its return spring 12*a*.

Figure 2:
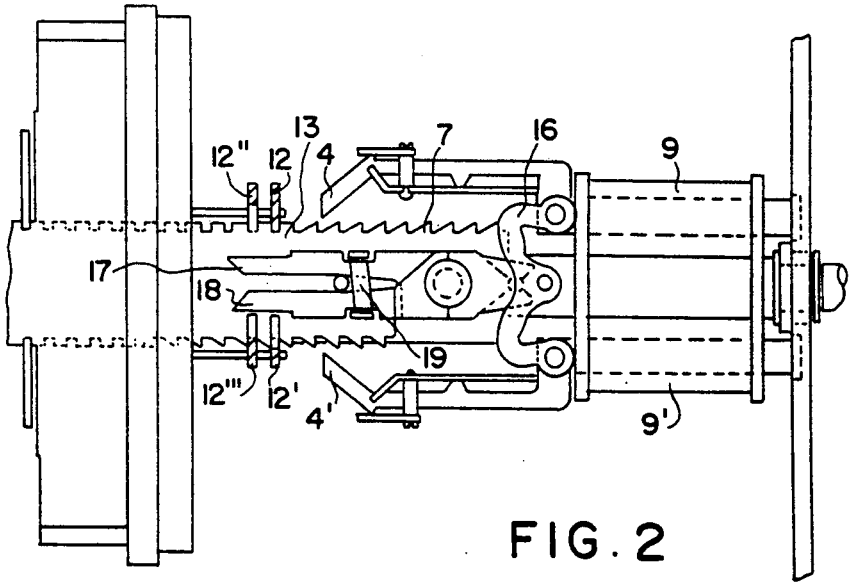
FIG. 2 A partial view of the franking machine at right angles to its mainshaft in the vicinity of the adjusting rod for the franking value settings, with a mechanism for cancelling all the value settings.

It is obvious that the described mechanism must be present four times for each value figure typewheel and for four decimal places. FIG. 2 shows four of the said detents 12, 12', 12'', 12'''.

The resetting to zero of the values set on the typewheels 2, e.g. if the cancel key CE on the control console (FIG. 5) is pressed or is pressed again for correcting a value entry key (21–25) on the control console, takes place in that two parallel acting drive magnets 9, 9' are simultaneously energized as a result of corresponding control signals of the control unit (FIGS. 6 and 7), so that, via bow-shaped member 16, they jointly spread apart in scissor-like manner to release catches 17, 18 mounted between the detents 12, 12', 12'', 12''' counter to the tension of a spring 19 (FIG. 2) and consequently disengage said detents. Thus, the tension spring 15 draws the racks 7 back into their starting or zero position and consequently the typewheels 2 are turned back into their zero position.

The back-indication of the zero positions to the central console unit (FIGS. 6 and 7) also takes place by means of the sensors 10, 11; 10', 11', because the detents 12, 12', 12'', 12''' in the corresponding position of the four racks 7 are located in the outwardly pivoted position on an untoothed, raised part 20 of the rack, as shown in FIG. 1.

Figure 4:
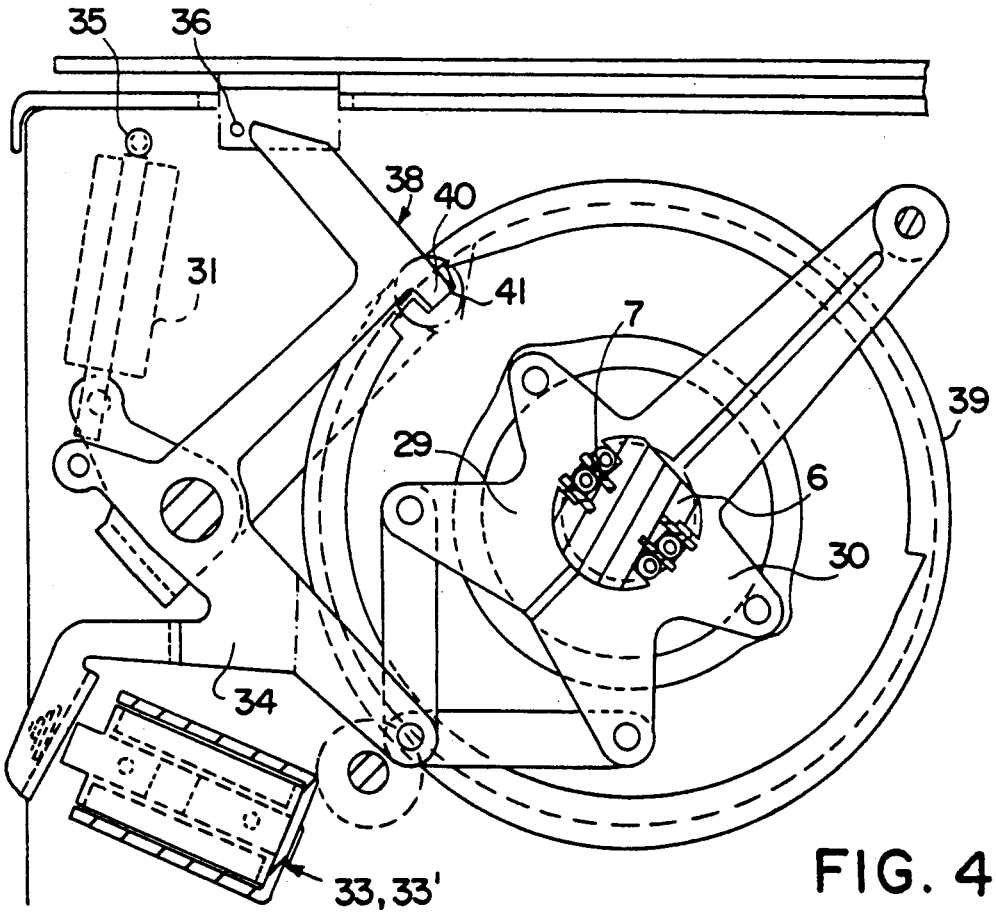
FIG. 4 A view of a retaining pawl mechanism with a section along line IV—IV of FIG. 1.
Figure 5:
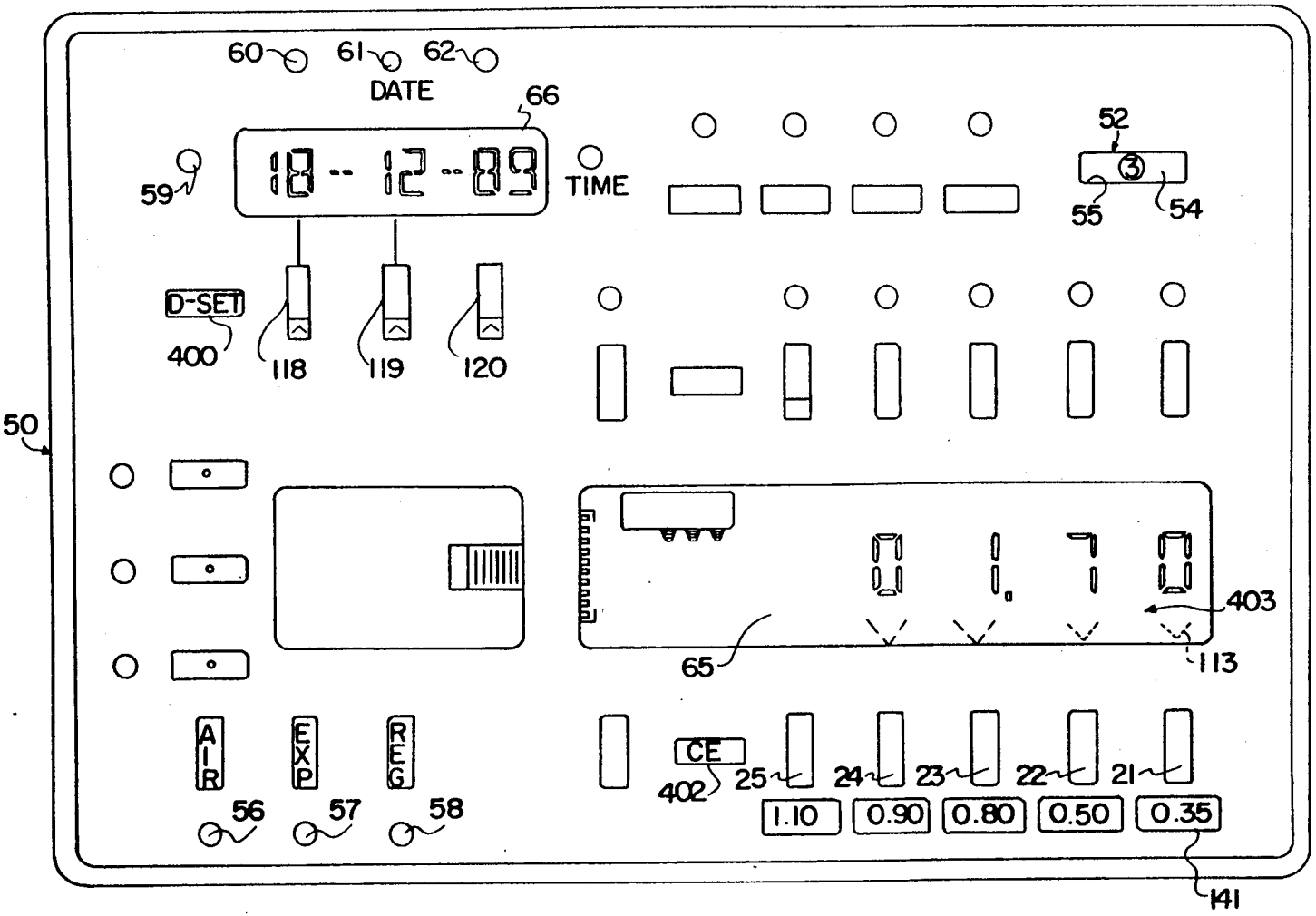
FIG. 5 A view of the control console of the franking machine.

For the additional securing of the setting positions succeeding one another in stepwise manner through the rod drive 4, 9 and for signalling to the central control unit (FIGS. 6 and 7) whether the setting by a complete position step has taken place, in accordance with FIGS. 1 and 4, the franking machine has a retaining pawl pair 29, 30 enveloping the machine mainshaft 6 and which, by the tension of a tension spring 31, is kept in engagement with a rectangular tooth system 32 of the racks 7. A solenoid 33 moves the retaining pawl pair 29, 30 via a transmission lever 34 against the tension of tension spring 31, so that said electromagnet 33 is supplied with current on each occasion just prior to the power supply to a drive magnet 9, 9' in order to temporarily release the engagement with the racks 7 for the shifting thereof into a new setting position. The back-indication of the position of the retaining pawl pair 29, 30 takes place by an optical sensor 35 located in the movement path of the transmission lever 34. If e.g. due to an excessively large operating resistance, during the setting displacement or racks 7 only an intermediate position is reached, in which the associated typewheel 2 does not have a clearly defined printing position, then at least one of the retaining pawls 29, 30 does not pass into a gap 32*a* of the rectangular tooth system 32 and the transmission lever 34 remains in an outer pivoted position, which by means of the sensor 35 is indicated to the central control unit (FIGS. 6 and 7) in the form of a fault signal.

The basic position of the machine mainshaft 6 is also monitored e.g. by a sensor 36, which is located in the movement path of a locking lever for the control wheel 39 fixed to the shaft 6. In FIG. 4 this locking lever 38 is covered by the transmission lever 34 having the same contour. In the basic position of the machine mainshaft 6, in which only the drive rods 4, 4' can engage with the associated rack 7, a hook part 40 of locking lever 38 is in engagement with a recess 41 of the control wheel. This engagement is not possible outside the basic position, so that sensor 36 indicates this to the central control unit via function field 96 (FIGS. 6 and 7). However, the monitoring of the rotation positions of the machine mainshaft can also take place by means of a perforated disk fixed thereto and sensors associated with said disk.

As can be gathered from the flowchart according to FIG. 9 for the program sequence of the central control unit (FIGS. 6 and 7), the signals of the said sensors are required for controlling the franking value setting.

The basic electronic elements used in the block diagram of the central control unit will be briefly explained hereinafter, referencing FIGS. 6 and 7.

The entry of the random instructions by means of said value entry keys 21–25, AIR 56, EXP 57, REG 58, D-SET 400, ENTER WT 180, SCALE 216, CE 402, etc. takes place by means of the control console 50. An ENCODER 51 converts the key signals into binary word signals, which pass to a BUSCONTROLLER and MULTIPLEXER 70. A key 52 is also connected via an ENCODER 53 to the latter and by means of five signals informs the control unit which user key 54 has been inserted in the key reception opening 55 on the control console 50, so that the consumed value quantities are added to the stored value quantity stock of the particular user.

This key is described in greater detail in U.S. Pat. No. 4,788,623. Moreover, as peripheral elements, the indicator lamps 56–62 of control console 50 and the display 65, 66 are connected via a decoder and a driver 67, 68 to the BUSCONTROLLER and MULTIPLEXER 70, so that, on the basis of information received as a binary word, they can be driven with the necessary electric power. A battery-operated clock 71 is also provided as a peripheral element for the automatic setting of the date on display 66, as well as on printing head 1.

The BUSCONTROLLER and MULTIPLEXER 70 periodically or spontaneously operates the peripheral elements 50, 52, 56–62, 65 and 66, separates the inputs and outputs and brings or reads the informations into sequential form to or from the peripheral bus 72. It can be constructed as a separate microprocessor.

Peripheral buses 72, 73 are connected to both ends of a central computer bus 74 across a bus isolator 75, 75' and a bus port 76, 77. The bus isolators 75 bring about a separation of the signals, so that no faults pass to the computer bus 74 and therefore to the master computer 80 (CPU). The bus port 76, 77 brings about a transfer of the signals from the rapid computer bus 74 to the slow peripheral bus 72, 73. The second peripheral bus leads to an INTERFACE CONTROLLER 78, which has a microcomputer system, in order to e.g. operate the interface "SCALE INTERFACE" 79 for a connected electronic balance. Such an interface is e.g. necessary in order to adapt the operation of the control unit and therefore the franking machine to those of an automatic letter supply means.

The correct function of the master computer 80 (CPU) is checked by an electronic "WATCH-DOG" unit 81, i.e. a computer and supply monitoring means. This restarts the master computer 80, if periodic control signals do not occur or if it attempts accesses to forbidden address areas. If the computer supply drops, it is switched off.

The "RELAY" unit 82 switches the supply of the electromotive drive of the machine mainshaft 6, the magnets 9, 9' of the rod drive 4, 4' and the solenoids 33 for moving the retaining pawls 29, 30 into the release position.

The drive 83 of the machine mainshaft 6 is connected by means of an OUTPUT PORT 84 and a DRIVER 85 to the computer bus 74. This output port 84 reads the information intended for this output at the correct moment from the computer bus 74 and stores this information. The driver 85 brings about a power amplification adapted to the drive 83. A further driver 86 is provided between the output port 84 and the solenoid 33' for the locking lever 38 of the machine mainshaft 6.

In the same way, the following magnet drives are controlled by the master computer (CPU 80) via an OUTPUT PORT 88–90 and associated driver 91–93: drive magnets 9, 9' for the drive rods 4, 4' of the franking value setting, not shown drive magnets 94 for corresponding, not shown drive rods according to FIGS. 1 to 4 of U.S. Pat. No. 4,520,725, which are used for the setting of the date typewheels of printing head 1 and a not shown retaining magnet 95 for a letter trip switch.

The retaining magnet 95 is activated if a letter trip switch provided on the franking table below the franking head 1 is operated by the striking of a letter to be franked. The retaining magnet 95 holds back the deflected switching contact of the letter trip switch, so that it cannot move the letter and so that the franking value impression takes place at the precisely predetermined point. It releases the trip switch as soon as the letter has left the release area.

In addition to the information supplied via BUS CONTROLLER 70 and computer bus 74 to the master computer (CPU 80), further information is supplied from sensors of the franking machine mechanism via input ports 97, 98. These are the sensors 10, 11, 10', 11' according to FIG. 3 for indicating back a timing movement of the drive rods 4, 4' via the in each case raised detents 12, 12', the sensor 35 for the position of the retaining pawls 29, 30 moved during each timing movement of the drive rods 4, 4', in order to signal the exact setting position of the racks 7, the sensor 36, which signals the basic position of the machine mainshaft 6 or the printing head 1 necessary for value setting and the sensor 99 for the presence of a letter to be franked on the franking table.

A further INPUT PORT 100 (FIG. 7) is provided for the connection of the POWER SUPPLY MONITOR 101. The latter provides an early warning to the master computer (CPU 80) regarding an imminent supply voltage failure. With the aid of the energy stored in support capacitors it is possible to complete most functions of the control unit. No new functions are started in the warning state.

Finally, the central control unit according to FIGS. 6 and 7 has several memories, i.e. a PERMANENT MEMORY 103, which is a ROM, PROM or EPROM, a temporary memory 104, which stores the function data, a non-volatile memory 105, which is a RAM with battery, a NOVRAM, an EEPROM or an EAROM and stores the intermediate results of the program sequence, and contains the postage rate table, as well as a removable permanent memory 106, which contains security codes required during the authorized loading of the value quantity memory. The latter can be a ROM, PROM, EPROM, EEPROM, EAROM, NOVRAM or RAM with battery.

Figure 8:
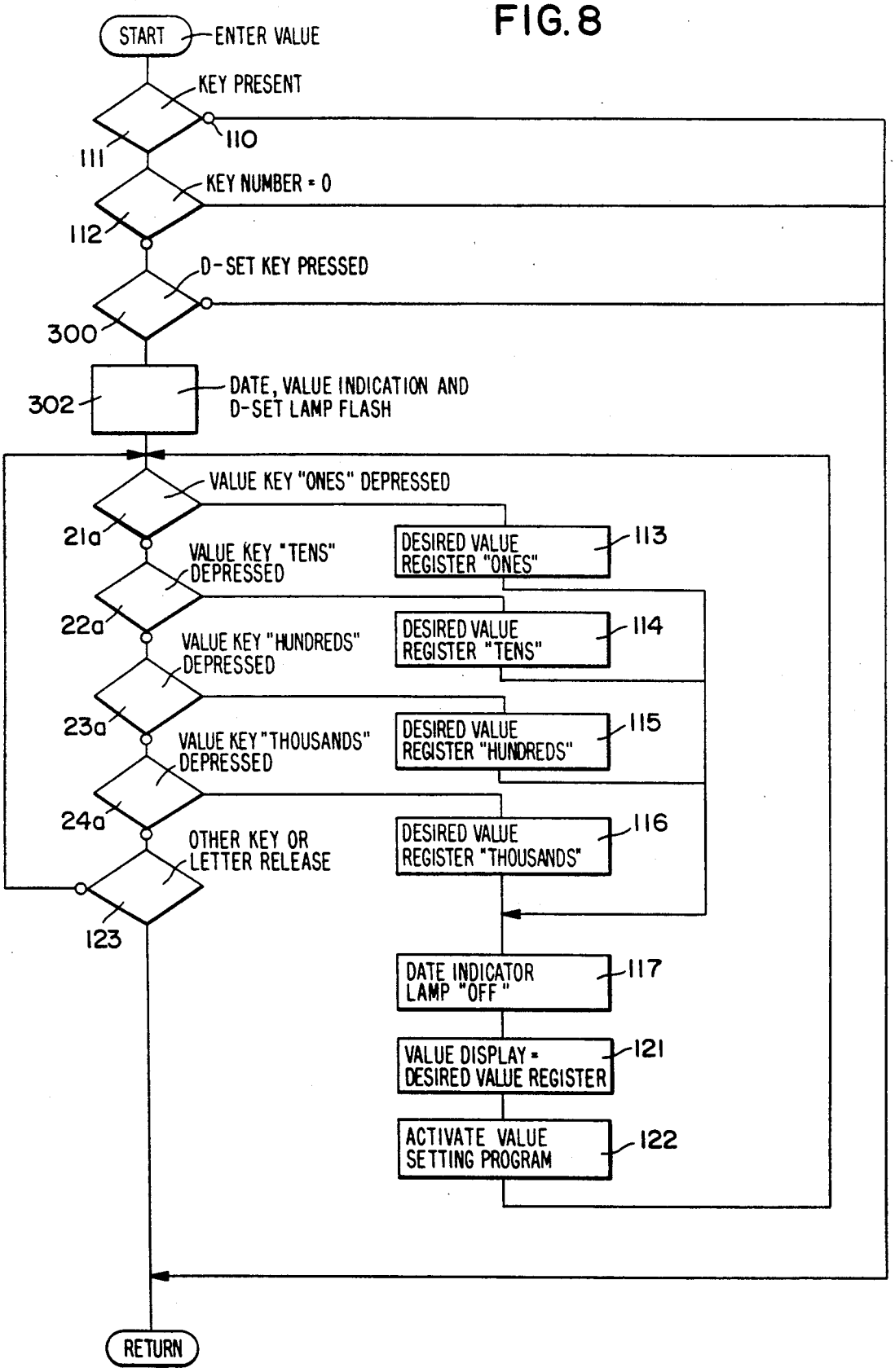
FIG. 8 A flowchart of a program sequence of the electronic control unit in the case of a cyclic operation of the keys for entering a franking value.

FIG. 8 diagrammatically shows the sequence of instructions 21*a*–24*a* in the program sequence during the cyclic entry of franking values via the keys 21–24 of the control console 50. The program path over a junction 110 indicated by a circle in each case if the legend associated with the particular branch, e.g. 111, "key present", does not apply. A check takes place at the first two branches 111, 112, whether a correct user key 54 has been inserted in the key opening 55 of the control console 50. Key number 0 is only to be used if the register of the value quantity to be stored in the franking machine is to be loaded.

The diagram shows, at function field 300, that for the timed value entry by means of keys 21–24, it is necessary to press the D-set key 400 beforehand. Subsequently there is flashing, according to step 302, of both of the indicator lamps 60–62 above the display 66 for the date and the decimal markings 403 on display 65 for the franking value entry. After pressing one of the value keys "ONES" 21, "TENS" 22, "HUNDREDS" 23 or "THOUSANDS" 24, the corresponding entry enters the associated desired value register corresponding to the particular decimal place, as shown by the function fields 113–116. The indicator lamps 60–62 are extinguished according to function field 117, because by operating a value key 21–24, in place of a date entry key 118–120, the decision to set a franking value was made. Each key pressing or entry clock advances the desired value register 113–116 of the corresponding decimal place by one digit, so that digits 0–9 can be entered.

According to function field 121, on display 65 appears the entered value and according to function field 122, the program for the mechanical value setting is immediately activated on printing head 1, as shown in FIG. 9. The process is ended according to function field 123 if subsequently, e.g. through the operation of the letter trip switch, the functional sequence for franking impression is initiated.

In accordance with the program sequence shown in FIG. 9 for the automatic value setting on printing head 1 of the franking machine, in accordance with function fields 125, 126, it is initially checked whether the machine mainshaft 6 has its basic position, in which the drive rods 4, 4' can engage with the racks 7 guided therein and whether e.g. there is no fault indication through sensor 35 of retaining pawls 29, 30. In accordance with the successive branches 127, 128, it is a prerequisite for the further value setting functional sequence, that the entered value quantity is not yet present in the actual value register and that a higher value quantity is present in the desired value register than in the actual value register. If this is not the case, in accordance with function field 129, magnets 9, 9', according to FIG. 2 are simultaneously activated, so that, in accordance with the preceding description, typewheels 2 for all the decimal places are reset to the position 0, so that the value setting to the value in the desired value register starts again from the beginning. The back-indication of this value cancellation takes place on branch 130 and for this purpose the sensors 10, 11, 10', 11' of detents 12, 12', 12'', 12''' are provided.

A check then takes place on branches 131, 132, 134 for each decimal place, i.e. the "ONES", the "TENS", the "HUNDREDS" and the "THOUSANDS", whether the desired value register content is higher than the actual value register content. In order to shorten the description the branch for the "HUNDREDS" and also the following field for setting the "THOUSANDS" are not shown. If the desired value register content is higher, then in accordance with the following function field 135, 312 solenoid 33 is activated for releasing the retaining pawls 29, 30 and subsequently, according to function field 136, 313 the movement of drive rods 4, 4' is carried out by activating the particular rod drive magnet 9, 9' until a number of movement cycles corresponding to the difference of the values of both register contents has been carried out, so that the branch 131, 132, 134 frees the paths 137, 138. The back-indication of the value cancellation for each decimal place takes place on branch 310, 314, 315. At the end, a program sequence for establishing faults in accordance with function field 140 is activated.

The entry process described by means of the flowcharts of FIGS. 8 and 9 is, however, only exceptionally used if no corresponding fixed value is associated with the entry keys 21–25 and the surcharge keys AIR, EXP and REG, by corresponding preprogramming.

FIG. 10 shows the program sequence for associating fixed franking amount quantities with said entry keys. After association has taken place, the entry keys 21–25 are identified by their stickers 141 indicating the fixed value and which are either stuck on them or, in accordance with the embodiment shown in FIG. 5, alongside them. According to FIG. 5, in addition to the fixed values AIR, EXP and REG, the fixed values 0.35, 0.50, 0.80, 0.90 and 1.10 are entered, which are the most frequently required franking machine values for individual users in Switzerland.

As in the case of the cyclic or incremental entry according to FIG. 8, wherein a check is made in accordance with branches 111, 112 in FIG. 10 a check is first carried out in branches 142, 143 to establish whether a key 54 acceptable for the program has been inserted in control console 50. The association of a previously entered amount, e.g. in accordance with the indicated fixed values with one of the entry keys, takes place by a simultaneous pressing of the D-set key and the particular entry key 21–25, AIR, EXP, REG, as indicated by the legend with respect to the branch fields 144–150. In the legend according to FIG. 10, the entry keys 21–25 are designated in accordance with their arrangement on the decimal places of the display 65. According to the function fields 151–158, subsequently the value register associated with said entry keys is brought to the actual value corresponding to the fixed value. At the end of fixed value storage, the display in display means 65 is at value 0000 according to step 320. The process is ended according to function field 322, e.g. through the operation of any other key or the letter trip switch.

Figure 11A:
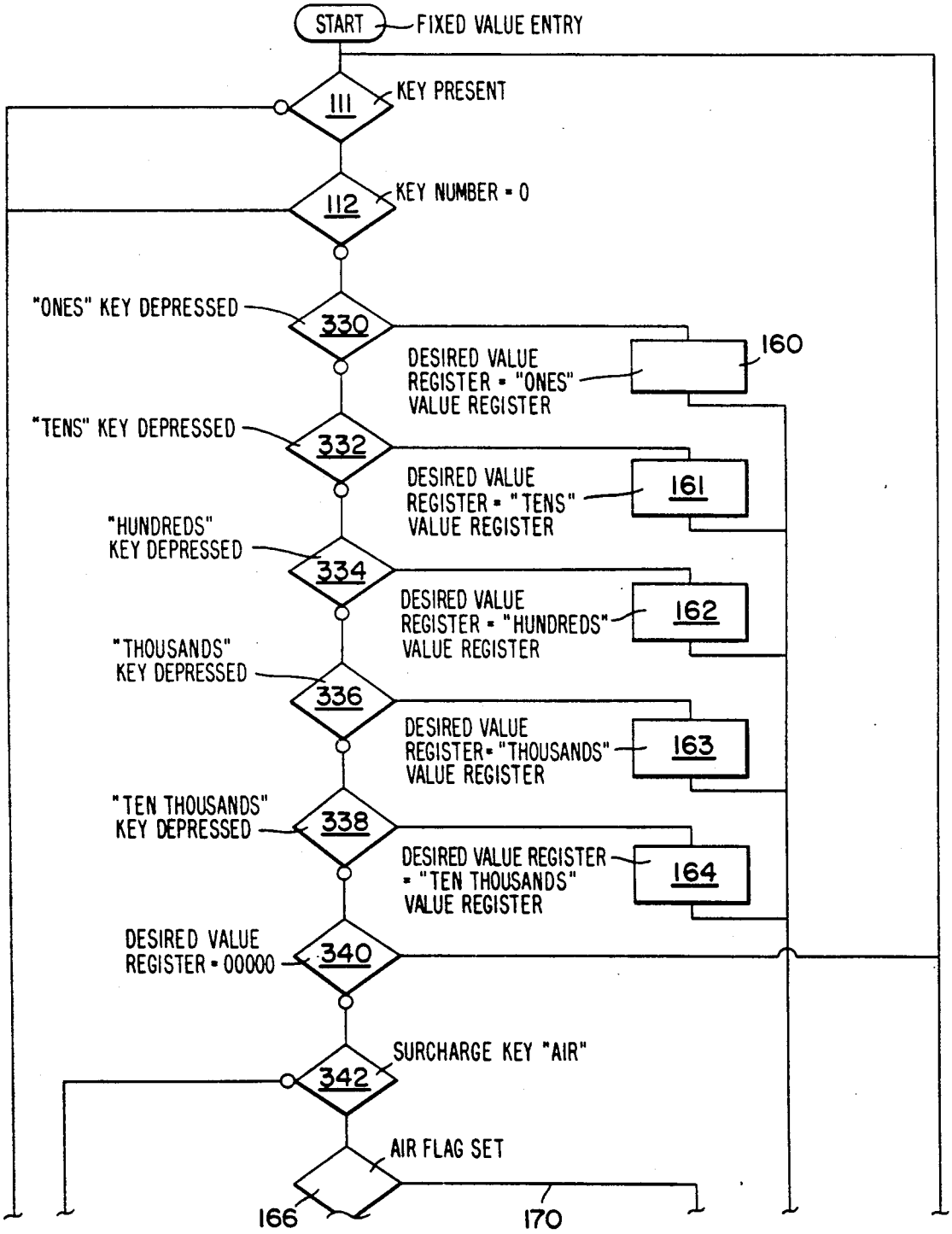
FIG. 11A The upper part of the flowchart of a program sequence in the case of franking value entry by means of keys for fixed, predetermined value amounts and by means of surcharge keys.
Figure 11B:
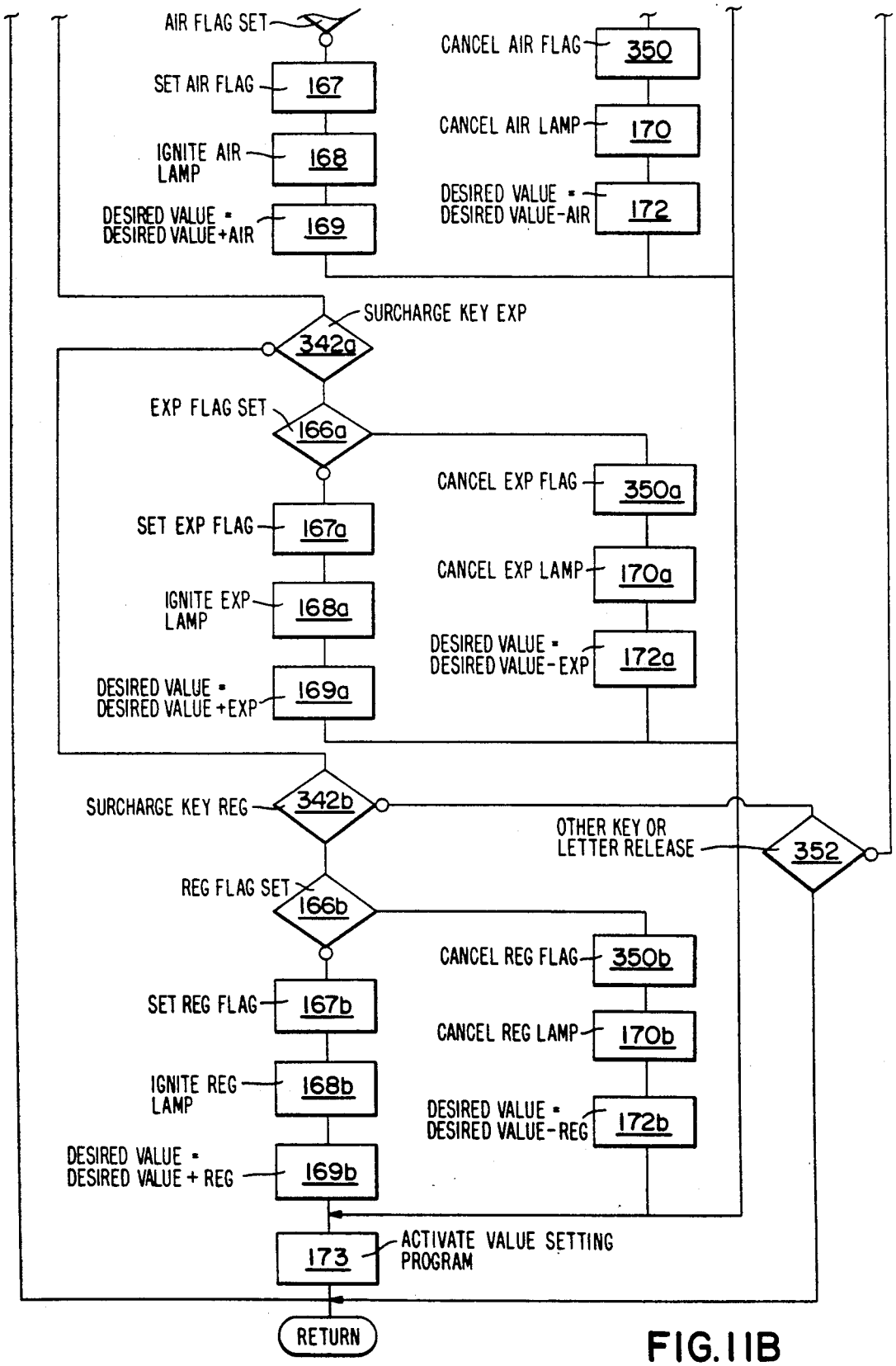
FIG. 11B The lower part of the flowchart according to FIG. 11A.

The program sequence for the entry of franking values by means of the entry keys which have become fixed value keys is represented in the flowchart according to FIGS. 11A and 11B. In the upper part of the chart according to FIG. 11A, it can be gathered from the legend relative to function fields 160–164, that after pressing the five entry keys 21–25 arranged at decimal places of the display 65, at function fields 330–338 the desired value register is set to the fixed value 0.35, 0.50, etc. corresponding to the particular entry key.

In the following part of the chart the program sequence is shown on pressing and further pressing of the surchange keys AIR, EXP and REG for the additionally required franking value amounts for airmail, express mail or registered mail. For example, if the desired value register is not 00000 as determined at function field 342, on pressing the surcharge key AIR, as sensed at function field 340, a check is carried out on branch 166 to establish whether by setting an AIR FLAG the corresponding state has been signalled. If not, in accordance with function field 167 the AIR FLAG is set and in accordance with the subsequent function fields 168, 169 the indicator lamp 56 of the control console 50 is lit up and the AIR surcharge added to the desired value entered according to the upper chart part.

If on pressing the surcharge key AIR, the AIR FLAG is already set and the lamp 56 indicating the surcharge function is already lit up, then the AIR FLAG is cancelled at function field 350 and AIR indicator lamp 56 is extinguished at function field 170, and according to function field 172 the AIR surcharge is deducted from the desired value already containing it. The program takes place in the same way on operating the other surcharge keys EXP and REG FIG. 11B showing similar function fields by numerals XXXa and XXXb. The process is ended according to function field 352, e.g. through the operation of any other kry or the letter trip switch. At the end of the program sequence of fixed value entry, in accordance with function field 173 the value setting program is activated and takes place in accordance with the flowchart of FIG. 9.

FIG. 12 shows the program sequence on entering the weight amount by means of the decimal keys 21–25, after previously pressing the special "ENTER WT" key 180 for initiating said program, according to function field 360, and after insuring that the franking machine printout has not been switched on by key 191. This key depression, in accordance with the function panel or fields 181 and 362 of the diagram, ensures that the light emitting diodes 182, 183 for the destination and size of the envelope or package to be franked light up on the control console 50, that the DEST and SIZE registers are reset to 0, and that according to the function field 184 the register FIGS. 185, 186, corresponding to the particular destination and size according to a table, appear on the auxilary display panel 66 where previously were displayed the day and year of the date display. If the "ENTER WT" key is not depressed and DEST is already set properly, function field 380 enables direct entry of the weight by depression of keys 21–25. According to function fields 187–189, the main display panel of the control console 50 accepts the display of a weight register of the control unit (FIGS. 6, 7) with the level zero, the captions "WEIGHT" and "gr" also being displayed according to function field 378. Weight entry takes place by pressing the decimal keys 21 to 25 and on each key depression for the corresponding decimal place the weight register advances by one digit in accordance with function fields 364–373.

Figure 13:
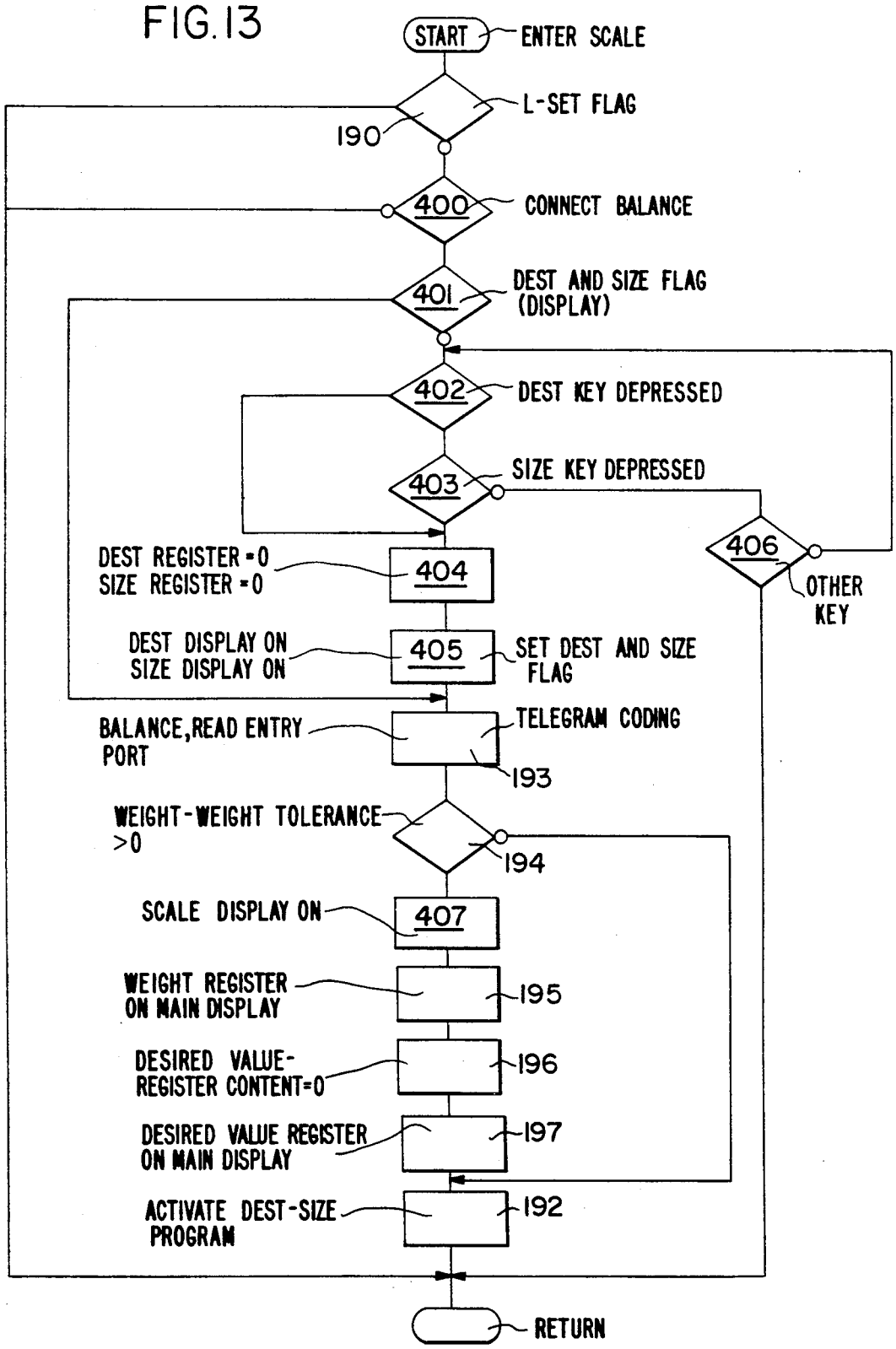
FIG. 13 A flowchart of a program sequence in the case of automatic weight entry by an electronic balance connected to the franking machine.

The process is ended according to function field 374, e.g. through the operation of any other key. The program is then continued upon proper DEST and SIZE being selected according to function field 376. Manual weight entry becanes superfluous, if an electronic balance is connected across an interface 79 according to FIG. 7 to the franking machine or its control unit. The corresponding program sequence corresponds to the flowchart according to FIG. 13. According to program branch 190 there is firstly a check to establish whether the franking machine printout has not been switched on by key 191 via labels. A subsequent check a function fields 400 and 401 is made to establish whether the electronic balance is connected and whether the destination and size of the envelope have been inputted. If the latter is not the case, the corresponding keys DEST and SIZE are depressed, as represented by function fields 402 and 403, and the associated registers are set to zero and turned on according to function fields 404 and 405, so that the set program "DEST" and "SIZE" can take place at the end of the program according to function field 192. If any other key than "SIZE" is depressed, the DEST-SIZE program is activated in function field 192 through the function field 406. According to function field 193 the entry from the balance is then read in and coded and branch 194 checks whether an entry on the basis of a weight of considerable magnitude has been read or whether in fact there is an envelope on the balance. If an envelope is on the scale, the SCALE display is turned on through function field 407. If according to program field 195 the weight appears on the main display 65, then according to program fields 196, 197 the desired value register is still at zero and appears on the main display. The desired value corresponding to the weight and the additional entries only appears according to program field 198 of the computer program of FIG. 15.

The register FIGS. 185, 186 for the destination (DEST) and the dispatch size (SIZE) are taken from a not shown table and subsequently inputted by means of in each case a timer. The timers start after depressing the corresponding entry key DEST 118 or SIZE 120 (recognized as being depressed by function fields 412 and 419, respectively and which are released again, by the DEST and SIZE timer stop and load function fields 418 and 426, after reaching the register figures referencing function fields 410 and 411 of FIG. 14A. In the same way as the SIZE key 120, the DEST key 118 can also be used for date entry and this then appears in the same display panel 66. If the timer has run through to the end (function fields 413–417 for DEST, and 420–424 for SIZE), then according to function field 200 or 201 it is re-loaded and starts again from the beginning. As can be gathered from the flow diagram, both register figures are entered according to the same diagram. According to FIG. 5 the register FIGS. "02" and "03" are entered.

Figure 14A:
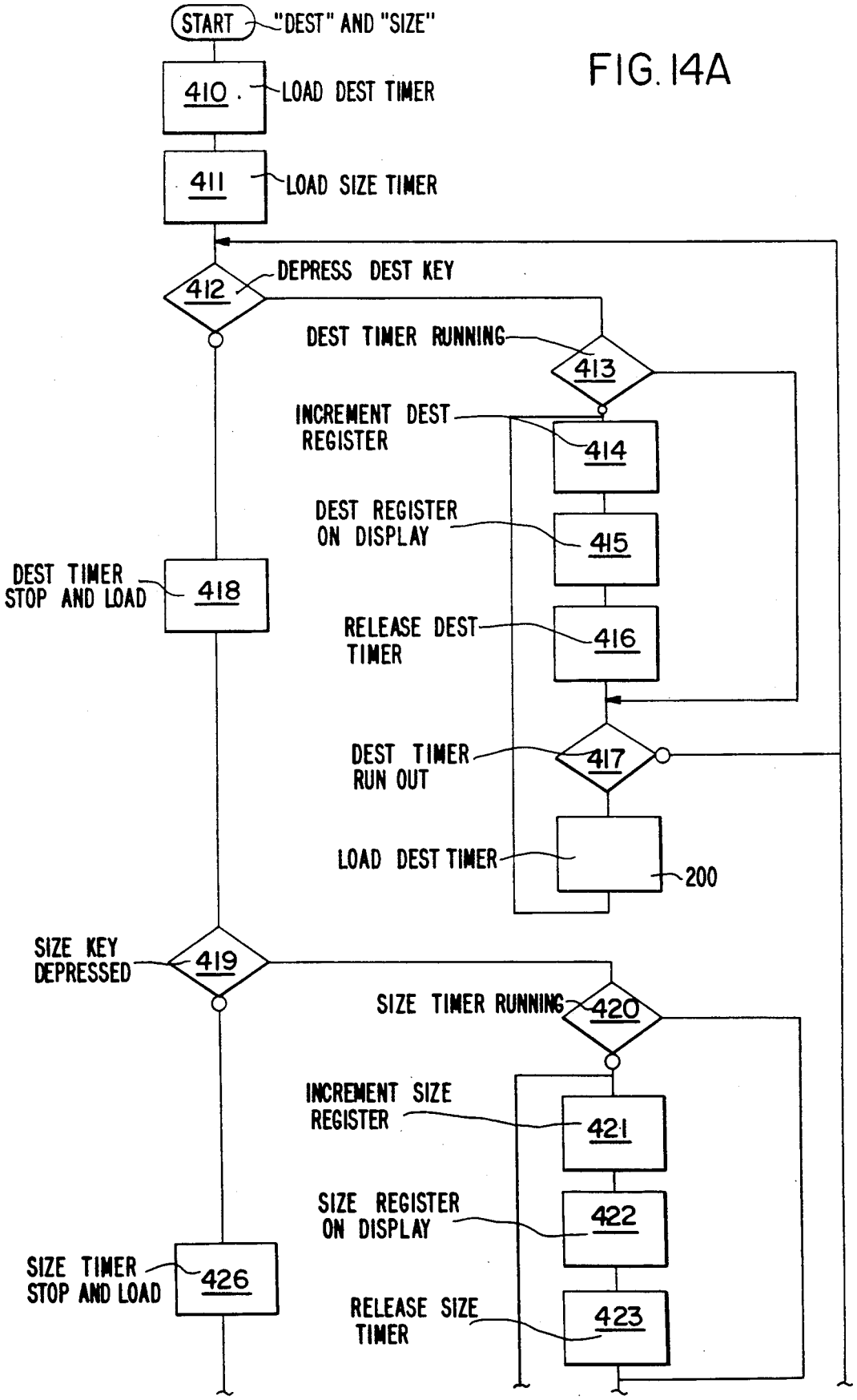
FIG. 14A The upper part of a program diagram on inputting additional information (DEST, SIZE) as well as surcharge amounts (AIR, EXP, REG).
Figure 14B:
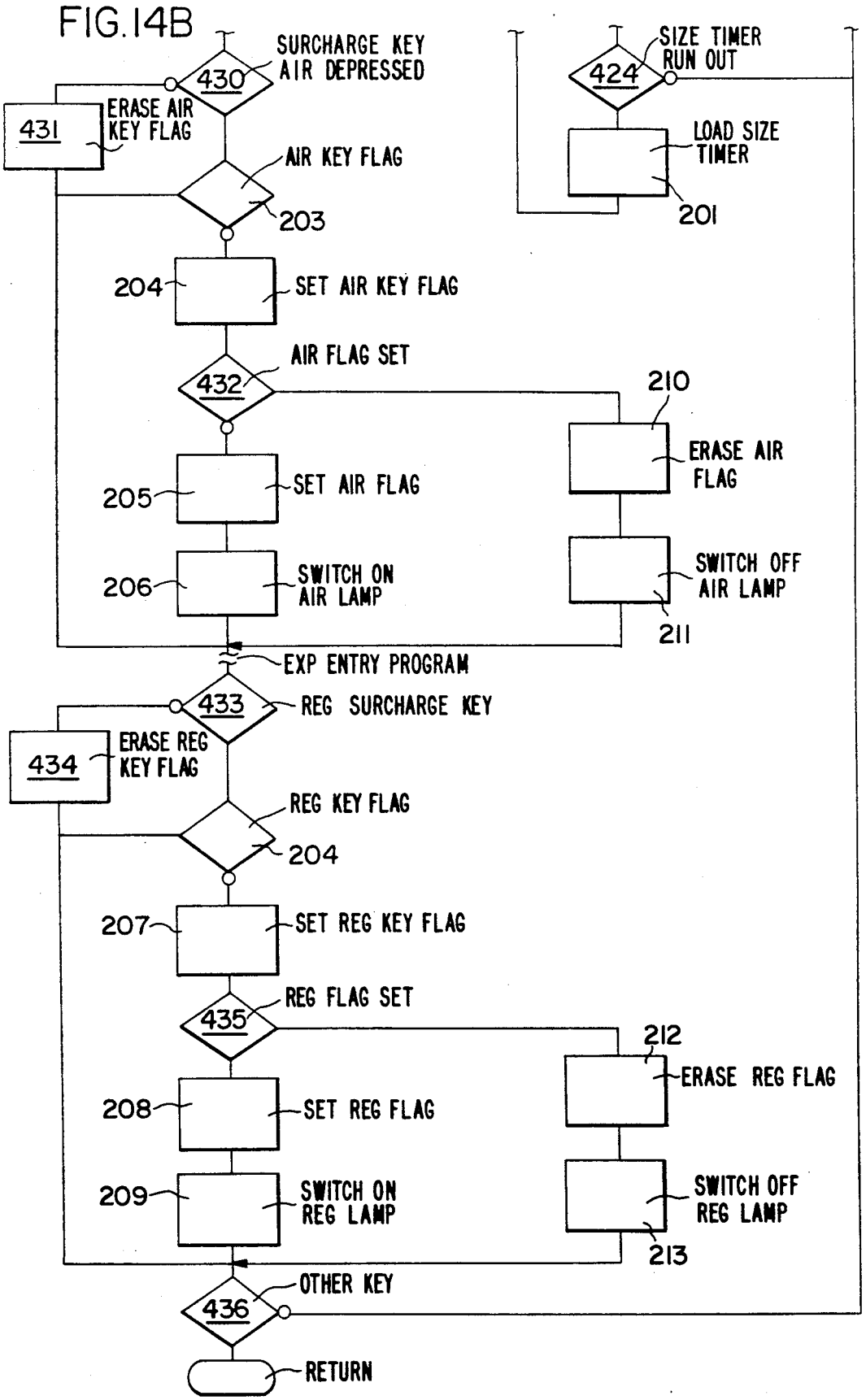
FIG. 14B The lower part of the program diagram of FIG. 14A.

In the further program sequence according to FIG. 14A, B, the surcharges AIR, EXP or REG are entered. As these three entries take place in accordance with the same diagram, that for the EXP entry has not been shown.

After pressing the entry key AIR 56, EXP 57 or REG 58, in accordance with function fields 430, 431 and branch 203, 204 of the flowchart a check is made in function field 432 to establish whether the corresponding entry has already been made, i.e. the key flag has already been set. If this is the case then the entry sequence is ended. If this is not the case, according to function fields 204 to 206, 207 to 209 the corresponding flags are set and the indicator lamps 182, 183 are lit up. If the AIR, EXP or REG flags were already set, then the depression of entry key 56-58 means that, according to program fields 210, 211 or 212, 213, the entry flag and the associated indicator lamp 182, 183 are extinguished. An unintentional depression of said entry keys 56-58 can consequently be cancelled out again with respect to its entry action. Function fields 433, 434, and 435 for the REG function are the same as function fields 430, 431, and 432, respectively, for the AIR function. Any other key, other than AIR, EXP, or REG terminates this function according to function field 436.

Figure 15:
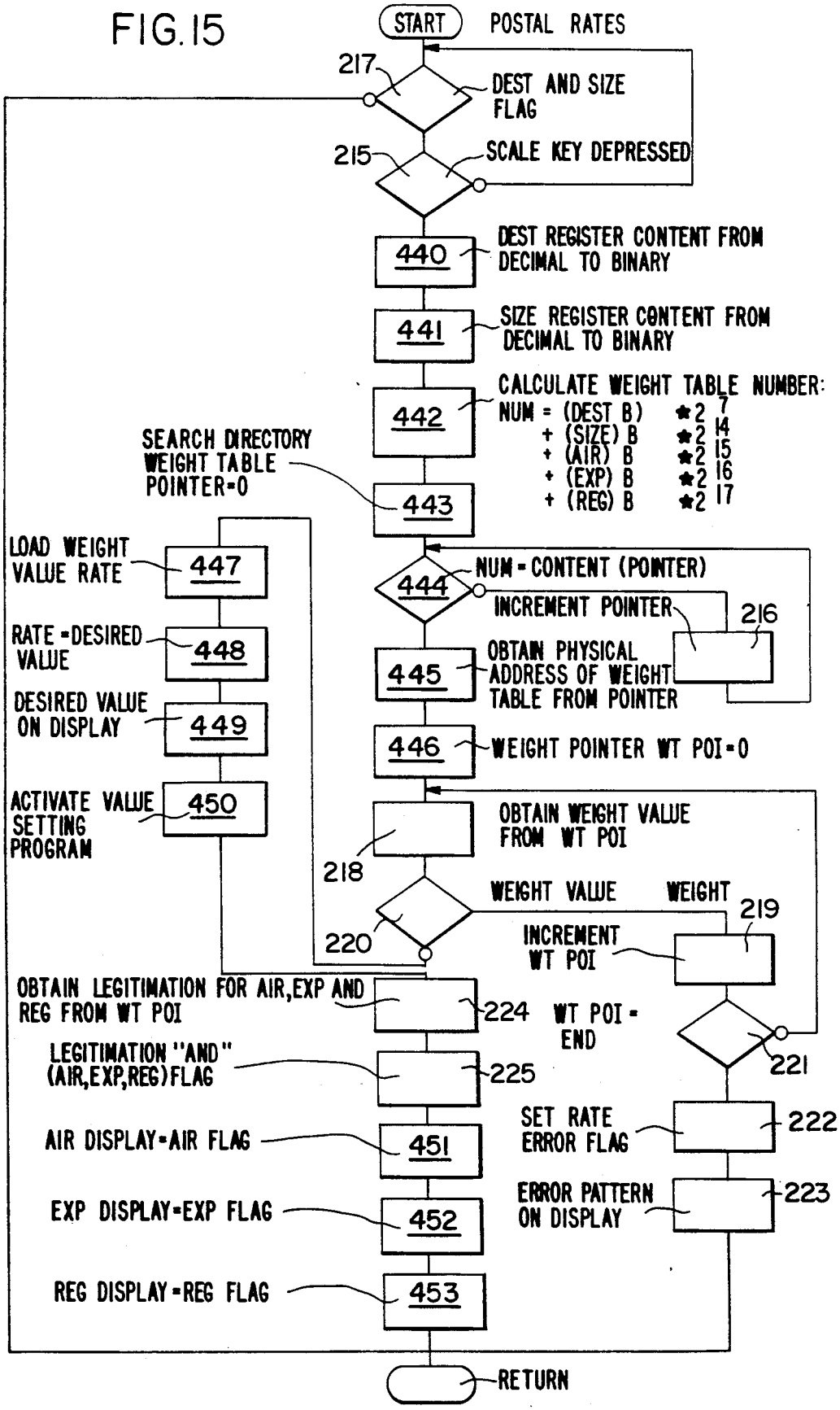
FIG. 15 A flowchart of the franking value calculation on the basis of the postage rates and entries according to FIGS. 12 or 13 and FIG. 14A, B.

For initiating the computing process for calculating the desired value for the franking after all the desired entries have been made, it is firstly necessary according to branch 215 of the flowchart of FIG. 15 to depress the SCALE key 216. A check is carried out on branch 217 to establish whether the entries DEST and SIZE have been made. Then a number "NUM" dependent on the binary form of the different entries from function fields 440–443 is then calculated in function field 444 according to the table shown and then a search is made in a weight table zone present in the control unit memory. According to diagram fields 444–446 and 216 the POINTER advances incrementally until the particular zone is reached and the weight pointer takes up its search function in the weight table, starting at the value zero, according to program field 218. Then by means of incremental searching according to program fields 219, 220 in the weight pointer or the corresponding subtable, the position is found at which the particular rate value appears. Thus, the rate value corresponds to the desired value appearing on display 65 according to program field 447–450. Thus, the value setting program can be activated in accordance with the flowchart shown in FIG. 9 and as a result the typewheels 2 are set to the desired value. According to the example shown in FIG. 5 on the basis of a weight of 1188 gram the value of 14.80 is calculated and set. If the weight pointer search according to program field 221 has ended unsuccessfully, the consequent error is displayed according to function fields 222, 223 on the main display 65, e.g. by the word "ERROR".

By means of the "legitimation" program fields 224, 225 a check is made by means of the rates table to establish whether the inputted destination (DEST) and dispatch type (AIR, EXP and REG) are not in contradiction with one another, because for certain destinations e.g. an EXP surcharge or AIR surcharge is not possible. The AIR, EXP, and REG flags are then set according to function fields 451–453.

The drawings and the foregoing description are not intended to represent the only form of the invention in regard to the details of its construction and manner of operation. Changes in form and in the proportion of parts, as well of substitution of equivalents, are contemplated as circumstances may suggest or render expedient; and although specific terms have been employed, they are intended in a generic and descriptive sense only and not for the purpose of limitation, the scope of the invention being delineated in the following claims:

What is claimed is:

1. A franking machine comprising:

a printing head fixed to a machine mainshaft;

a drive for said machine mainshaft in order to rotate said printing head for at least one printing cycle;

typewheels mounted in rotary manner in said printing head for printing a franking value;

an electromechanical drive including control members for each of said typewheels for setting a desired franking value;

mechanical locking means for securing the set positions of said control members of said electromechanical drive;

a central electronic control unit including a memory in which is stored a postal rate table, and a program memory for automatically controlling said electromechanical drive;

sensors for supplying position signals of said locking means to said central electronic control unit for the control of said electromechanical drive;

a control console comprising a keyboard for the random inputting of instructions to said control unit for setting said typewheels of said printing head, at least one display panel for the display of the inputted instructions, and entry means for entering the weight of an article to be franked; and a computer for calculating the franking value on the basis of the weight entry, said program memory automatically controlling the timing and operating functions of said electromechanical drive on the basis of the calculated franking value; and wherein:

said entry means for entering the weight comprises a special key for the choice of a weight entry program, so that said keyboard defines an entry means for the weight; and the number of keys necessary for entering the weight corresponds to the number of decimal places of a maximum amount to be entered.

2. A franking machine according to claim 1, wherein said keyboard includes entry keys for inputting information from said control unit relating to the destination of the article to be franked, its size, and its dispatch type.

3. A franking machine comprising:

a printing head fixed to a machine mainshaft;

a drive for said machine mainshaft in order to rotate said printing head for at least one printing cycle;

typewheels mounted in rotary manner in said printing head for printing a franking value;

an electromechanical drive including control members for each of said typewheels for setting a desired franking value;

mechanical locking means for securing the set positions of said control members of said electromechanical drive;

a central electronic control unit including a memory in which is stored a postal rate table, and a program memory for automatically controlling said electromechanical drive;

sensors for supplying position signals of said locking means to said central electronic control unit for the control of said electromechanical drive;

a control console comprising a keyboard for the random inputting of instructions to said control unit for setting said typewheels of said printing head, at least one display panel for the display of the inputted instructions, and entry means for entering the weight of an article to be franked; and a computer for calculating the franking value on the basis of the weight entry, said program memory automatically controlling the timing and operating functions of said electromechanical drive on the basis of the calculated franking value; and wherein:

said keyboard is a multipurpose keyboard and is provided with special keys which selectively configure said keyboard for weight entry, a fixed franking value entry, and an incremental value entry; and the number of keys necessary for entering the weight corresponds to the number of decimal places of a maximum amount to be entered.

* * * * *